US010709622B2

(12) United States Patent
Parker

(10) Patent No.: US 10,709,622 B2
(45) Date of Patent: Jul. 14, 2020

(54) NEONATAL TRANSPORT APPARATUS AND RELATED SYSTEMS

(71) Applicant: Children's Health Care, Minneapolis, MN (US)

(72) Inventor: Robert Preston Parker, Westborough, MA (US)

(73) Assignee: CHILDREN'S HEALTH CARE, Minneapolis, MN (US)

( * ) Notice: Subject to any disclaimer, the term of this patent is extended or adjusted under 35 U.S.C. 154(b) by 320 days.

(21) Appl. No.: 15/800,549

(22) Filed: Nov. 1, 2017

(65) Prior Publication Data

US 2019/0125598 A1 May 2, 2019

(51) Int. Cl.

| | |
|---|---|
| ***A61G 1/04*** | (2006.01) |
| ***A61G 11/00*** | (2006.01) |
| ***A61G 1/02*** | (2006.01) |
| ***A61G 1/052*** | (2006.01) |

(52) U.S. Cl.

CPC ..... *A61G 1/042* (2016.11); *A61G 1/052* (2013.01); *A61G 1/0237* (2013.01); *A61G 11/001* (2013.01)

(58) Field of Classification Search

CPC ..... A61G 1/00–06; A61G 11/00–009

See application file for complete search history.

(56) References Cited

U.S. PATENT DOCUMENTS 5,018,931 A * 5/1991 Uttley ..... A61G 7/08 188/5
5,149,030 A * 9/1992 Cockrill ..... A61G 1/04 248/129
6,155,970 A * 12/2000 Dykes ..... A61G 11/00 5/610
6,527,263 B1 3/2003 Verbrugge
7,044,553 B2 5/2006 Ropp
9,114,907 B2 8/2015 Maas et al.
2006/0236456 A1 10/2006 Beale
2007/0089236 A1* 4/2007 Bailey-VanKuren .... A61G 1/02 5/1
2007/0219468 A1 9/2007 Shah et al.
2010/0185045 A1* 7/2010 Chinn ..... A61G 1/0293 600/22

(Continued)

FOREIGN PATENT DOCUMENTS

JP 0694069 A 4/1994

OTHER PUBLICATIONS

Blaxter et al., "Neonatal head and torso vibration exposure during inter-hospital transfer," Journal of Engineering in Medicine, vol. 231(2), pp. 99-113, 2017.

*Primary Examiner* — Thaddeus B Cox
(74) *Attorney, Agent, or Firm* — Merchant & Gould P.C.

(57) ABSTRACT

Various implementations include neonatal transport apparatuses and systems employing such apparatuses. In one particular implementation, an apparatus includes: an isolation stage; a first mount on a first portion of the isolation stage, the first mount configured to engage a mounting frame of a neonatal transport unit; a second mount on a second portion of the isolation stage, the second mount configured to engage a stretcher; and a stabilizing coupler extending from the second portion of the isolation stage, the stabilizing coupler positioned to directly couple the isolation stage with a floor underlying the stretcher.

18 Claims, 6 Drawing Sheets

(56) References Cited

U.S. PATENT DOCUMENTS

| | | | | |
|---|---|---|---|---|
| 2011/0260483 | A1* | 10/2011 | Chinn | A61G 1/0562 296/20 |
| 2014/0003614 | A1 | 1/2014 | Levitov et al. | |
| 2014/0051913 | A1* | 2/2014 | Arnold | A61G 11/00 600/22 |
| 2016/0015586 | A1 | 1/2016 | Sabota et al. | |
| 2017/0246059 | A1* | 8/2017 | Chinn | A47C 19/02 |

* cited by examiner

NEONATAL TRANSPORT APPARATUS AND RELATED SYSTEMS

TECHNICAL FIELD

This disclosure generally relates to medical transportation systems. More particularly, the disclosure relates to an apparatus for transporting children.

BACKGROUND

Numerous problematic births occur each year requiring a neonatal intensive care unit (NICU) at hospitals which do not have such a NICU facility. In these cases, the child is transported by ambulance or helicopter from the hospital in which they were born to a facility with a NICU. However, conventional transport systems for children (e.g., newborn children) allow those newborns to experience significant transportation-related vibration, which can negatively affect the health of those children.

SUMMARY

All examples and features mentioned below can be combined in any technically possible way.

Various implementations include a neonatal transport apparatus. In some implementations, these neonatal transport apparatuses have a stabilizing coupler to directly couple an isolation stage with a floor.

In some particular aspects, a neonatal transport apparatus includes: an isolation stage; a first mount on a first portion of the isolation stage, the first mount configured to engage a mounting frame of a neonatal transport unit; a second mount on a second portion of the isolation stage, the second mount configured to engage a stretcher; and a stabilizing coupler extending from the second portion of the isolation stage, the stabilizing coupler positioned to directly couple the isolation stage with a floor underlying the stretcher.

In other particular aspects, a system includes: a stretcher having: a set of wheels; and a stretcher mount coupled with the set of wheels; and an isolation apparatus coupled with the stretcher mount, the isolation apparatus including: an isolation stage; a first mount on a first portion of the isolation stage, the first mount configured to engage a neonatal transport unit; a second mount on a second portion of the isolation stage, the second mount coupled with the stretcher mount of the stretcher; and a stabilizing coupler extending from the second portion of the isolation stage, the stabilizing coupler positioned to directly couple the isolation stage with a floor underlying the stretcher.

In yet other particular aspects, a system includes a neonatal transport unit having: a mounting frame; and an incubation chamber coupled with the mounting frame, the incubation chamber containing: a platform having a recess therein; a removable tray in the recess; and at least one cushion layer over the removable tray within the recess; and an isolation apparatus coupled with the neonatal transport unit, the isolation apparatus having: an isolation stage; a first mount on a first portion of the isolation stage, the first mount coupled with the mounting frame of the neonatal transport unit; a second mount on a second portion of the isolation stage, the second mount configured to engage a stretcher; and a stabilizing coupler extending from the second side of the isolation stage, the stabilizing coupler positioned to directly couple the isolation stage with a floor underlying the stretcher.

Implementations may include one of the following features, or any combination thereof.

In some cases, the stabilizing coupler is configured to couple the isolation stage with the floor in addition to a connection between the stretcher and the floor, and the stabilizing coupler is further configured to couple the isolation stage with the stretcher.

In certain implementations, the isolation stage includes a z-isolation stage. In particular cases, the z-isolation stage further includes a scissor mechanism. In some implementations, the scissor mechanism further includes: a central joint; and a set of arms coupled at the central joint, the set of arms configured to pivot about the central joint for isolating relative vibration between the neonatal transport unit and a mount of the stretcher. In particular cases, the second mount includes two distinct mounts on two distinct arms in the set of arms, and the z-isolation stage further comprises a strut connecting the two distinct arms. In certain implementations, the central joint permits movement of the set of arms in a Z direction, and the isolation stage further includes: a first set of linear bearings permitting movement of the neonatal transport unit in an X direction perpendicular to the Z direction; a second set of linear bearings permitting movement of the neonatal transport unit in a Y direction perpendicular to the Z direction and the X direction; and a set of thrust bearings permitting yaw in the neonatal transport unit.

In particular cases, the first mount includes a clamping system for clamping the mounting frame to the isolation stage. In some implementations, the clamping system eliminates lash between the mounting frame and the isolation stage.

In certain cases, the isolation stage is centered in an X direction by a spring assembly, and is centered in the Y direction and yaw axis by additional spring assemblies. In particular implementations, at least one of the spring assemblies includes: a pair of aligned actuators having opposing couplers; and a spring between the pair of aligned actuators, where actuating the pair of aligned actuators in either of two distinct directions imparts a compressive force on the spring.

In some cases, the isolation stage further includes an air spring for controlling vertical centering of the isolation stage and the neonatal transport unit. In certain implementations, the air spring includes an air chamber and an air container fluidly connected with the air chamber, where air is configured to flow freely between the air chamber and the air container to control a spring rate of the neonatal transport unit.

In particular cases, the floor includes a floor of a roadway compliant vehicle or an airborne compliant vehicle.

In some implementations, the neonatal transport unit includes an incubation chamber and a mounting frame coupled with the incubation chamber, and the first mount includes a clamping system for clamping the mounting frame to the isolation stage.

In certain cases, the incubation chamber contains: a platform having a recess therein; a removable tray in the recess; a foam layer over the removable tray within the recess; and a gel mattress overlying the foam layer.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
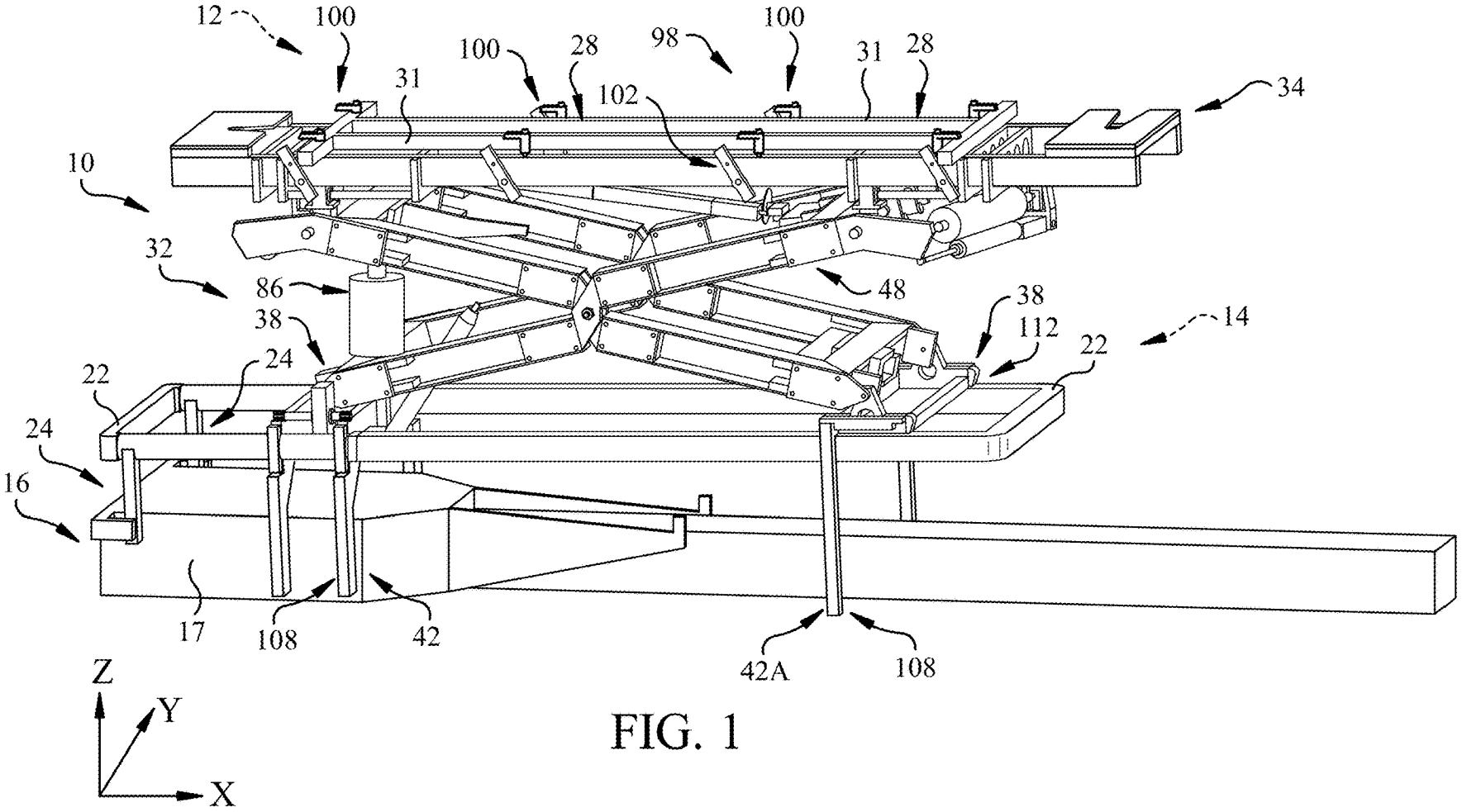
FIG. 1 shows a perspective view of a neonatal transport apparatus and portions of a stretcher and a neonatal transport unit, according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a neonatal transport apparatus with an isolation stage can be beneficially incorporated into a neonatal transport system. For example, an apparatus with an isolation stage and a stabilizing coupler can be configured to reduce vibration experienced by a child during transport.

Commonly labeled components in the FIGURES are considered to be substantially equivalent components for the purposes of illustration, and redundant discussion of those components is omitted for clarity.

As described herein, conventional neonatal transport systems fail to mitigate the vibration experienced by the transported child, contributing to negative health outcomes for that child. In particular, conventional neonatal transport systems include an incubator along with a mounting frame for coupling the chamber with a transport device. The incubator can include a chamber with a mattress for holding the child, as well as an assembly of supporting equipment (e.g., compressed gas containers, monitoring equipment, batteries/power supplies) for maintaining desired conditions in the chamber. The incubator and mounting frame can collectively weigh up to several hundred pounds. As such, a wheeled stretcher is commonly used to transport the incubator within a hospital facility and to/from a transport vehicle such as an ambulance or helicopter.

During the course of travel, e.g., while driving an ambulance or flying a helicopter, the floor of the transport vehicle experiences acceleration in response to surface effects (e.g., road surface effects such as pot holes or topography), control inputs (e.g., steering, throttling, braking), and incidental vibration related to engine speed (and in the case of road transport, tire rotation rate). If the transport assembly and the transportation vehicle were rigidly assembled, then the movement of the vehicle (e.g., vertical, left-right and front-back acceleration at the floor) would be coupled to the child. However, these transport assemblies are not actually rigid, and instead, have mechanical connections that are compliant through one range of motion and much stiffer near the end of that motion. These non-linearities can generate greater peaks of acceleration than would be otherwise experienced. Additionally, resonant modes in the transport assembly can accentuate acceleration at particular frequencies.

In contrast to conventional neonatal transport systems, various implementations include an apparatus and related system for isolating vibration during neonatal transport. In particular implementations, an apparatus includes an isolation stage and a stabilizing coupler for controlling vibration in a neonatal transport unit. The stabilizing coupler can separately couple the isolation stage directly with a floor underlying the stretcher which supports the isolation stage and the neonatal transport unit. That is, the apparatus is configured to directly couple the isolation stage with the floor in addition to the connection between the stretcher and the floor. This additional, direct connection can significantly reduce the non-linearities associated with transportation that increase the vibration experienced by the baby (e.g., at the baby's head). The apparatus can further include a clamping system for coupling the isolation stage with a mounting frame for the neonatal transport unit. The clamping system can eliminate lash (or, looseness) between isolation stage and the mounting frame.

It is understood that the apparatuses and systems described herein can be applied to a variety of transportation applications. That is, the apparatuses and systems disclosed according to various implementations can be configured to provide vibration isolation in transportation of children, as well as adults, in numerous transportation scenarios.

Figure 2:
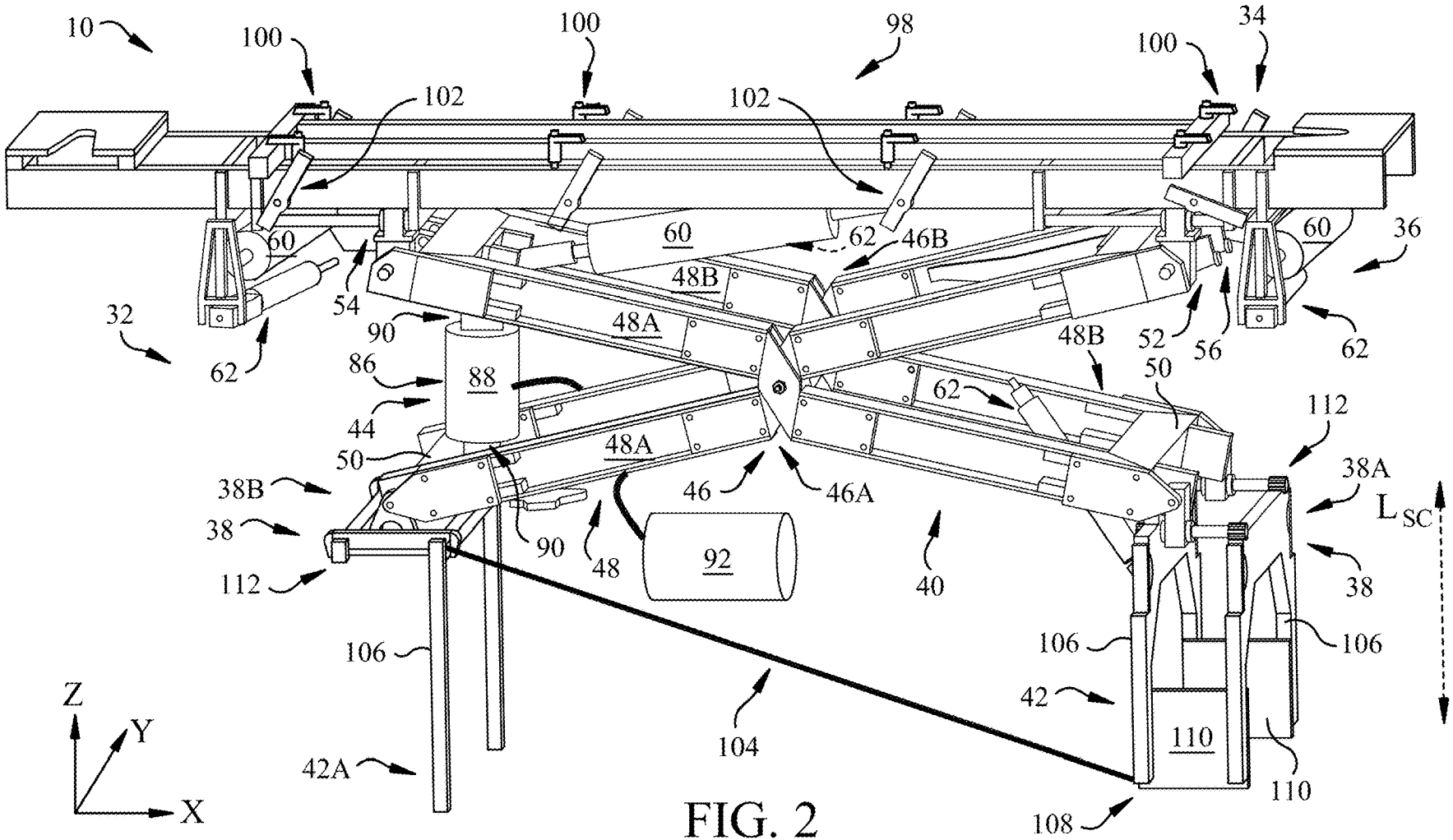
FIG. 2 shows a close-up perspective view of the neonatal transport apparatus of FIG. 1.

FIG. 1 shows a neonatal transport apparatus (or simply, apparatus) 10 coupled with a portion of a neonatal transport unit 12 (shown in detail in FIG. 4), as well as a portion of a stretcher 14, according to various implementations. FIG. 2 illustrates the apparatus 10 in isolation. In the depiction of FIG. 1, the portion of the stretcher 14 is additionally coupled with a floor 16, which can include the floor of a roadway compliant vehicle (e.g., an ambulance) or an airborne compliant vehicle (e.g., a helicopter). In some cases, the floor 16 includes a mount 17, which can include a rail or other mating feature for receiving the stretcher 14. Aspects of the neonatal transport unit 12 and stretcher 14 are described in order to clarify features of the apparatus 10. As such, various FIGURES are referred to simultaneously.

Figure 3:
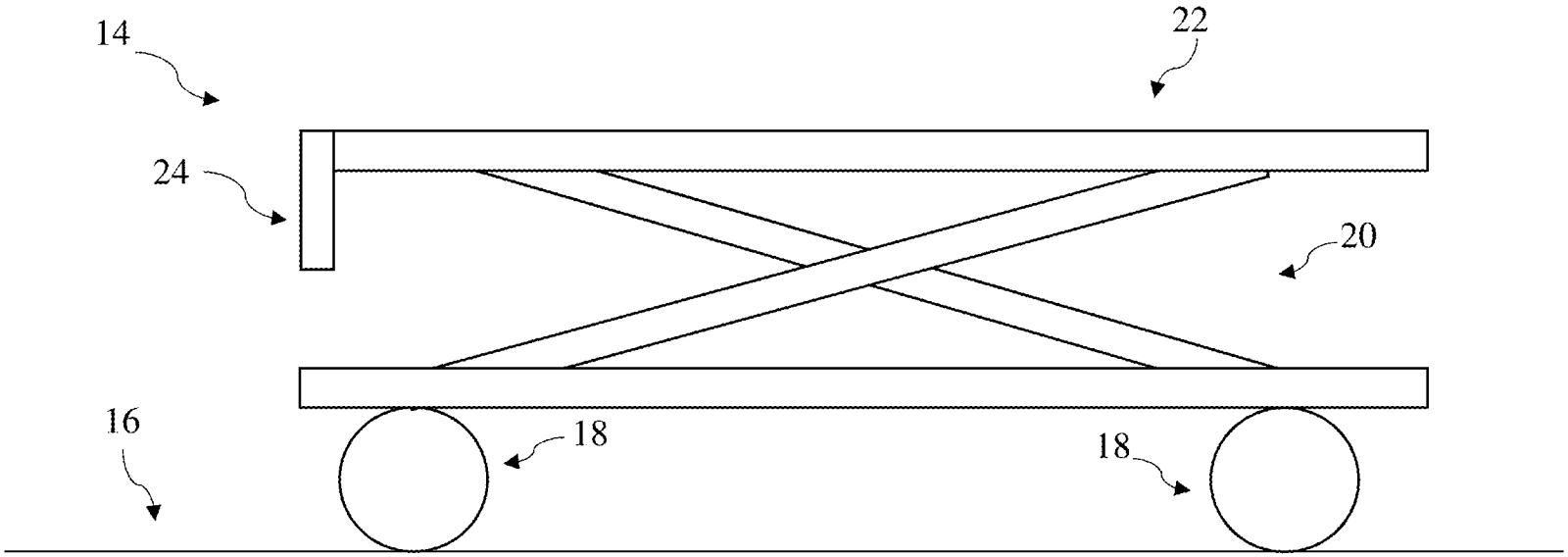
FIG. 3 shows a schematic side view of an example stretcher.

FIG. 3 shows a schematic view of an example stretcher 14. The stretcher 14 can include a set of wheels 18 allowing for transport along one or more surfaces, as well as a collapsible core 20 connected with wheels 18, and a stretcher mount 22 (FIG. 1, FIG. 3) connected with the collapsible core 20. The stretcher mount 22 can be configured to connect with a transport unit, such as the neonatal transport unit 12 (FIG. 4) or a bed or other carrier for transporting a patient. The collapsible core 20 can permit movement of the stretcher mount 22 relative to the wheels 18, e.g., to move the stretcher 14 into and/or out of a transport vehicle. The stretcher 14 can further include a floor coupler 24 for anchoring the stretcher 14 to the floor 16. The floor coupler 24 can include a hook, bar, or any conventional mating system for connecting the stretcher 14 with the floor 16, e.g., an antler coupling including a rail and clamp mechanism. In some cases, the floor coupler 24 can include a capturing mechanism for connecting the stretcher 14 with the floor 16 when the stretcher 14 is positioned at a particular location along the floor 16, e.g., slidingly engaging the mount 17 (e.g., a slot) in the floor 16 (FIG. 1).

Figure 4:
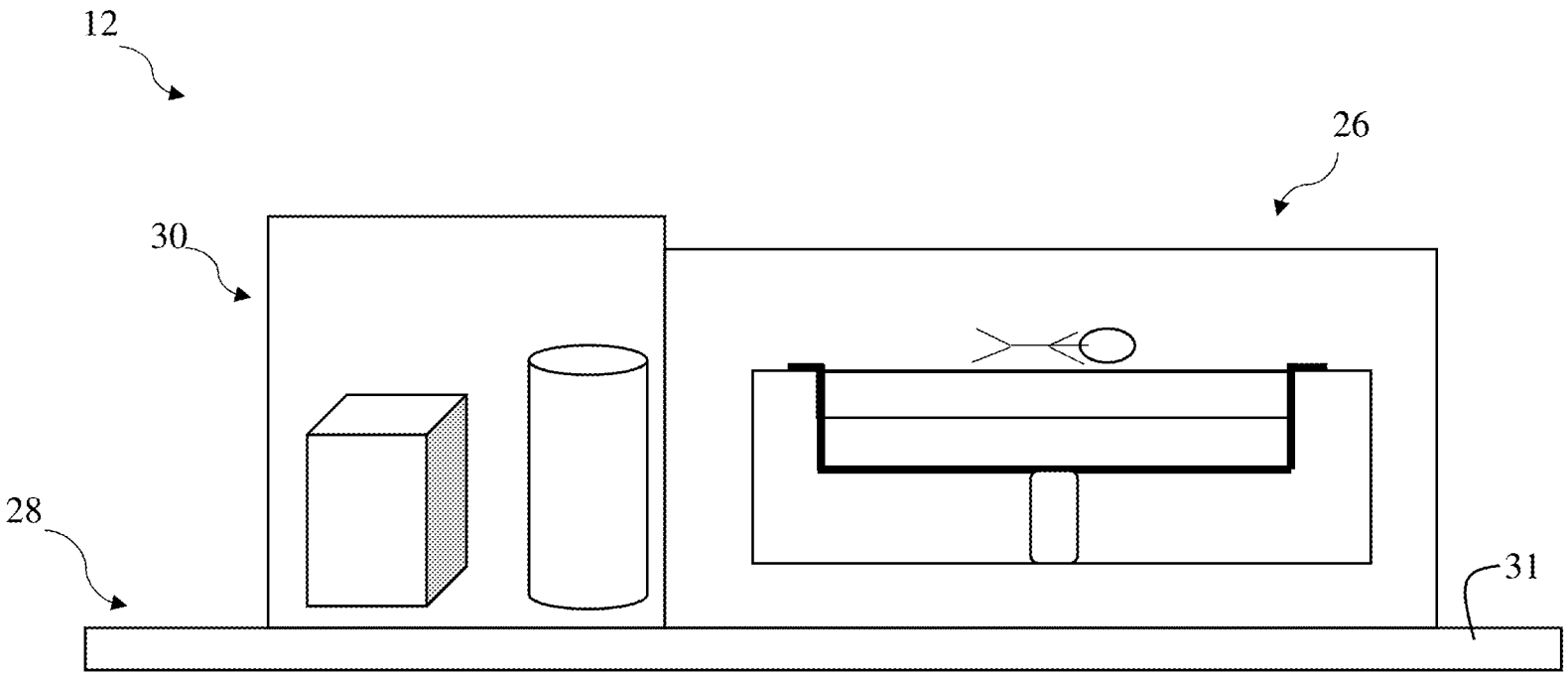
FIG. 4 shows a schematic side view of a neonatal transport unit according to various implementations.

FIG. 4 shows a schematic side view of a neonatal transport unit 12 according to some implementations. The neonatal transport unit 12 can include an incubation chamber 26 and a mounting frame 28 connected with the incubation chamber 26. Additionally, as described herein, the neonatal transport unit 12 can include supporting equipment 30 for maintaining desired environmental conditions in the incubation chamber 26. In some cases, the supporting equipment 30 can include compressed gas containers, monitoring equipment, batteries and/or other power supplies, conduits, sensors, etc. The supporting equipment 30 can also be coupled with the mounting frame 28, and can be configured to be transported with the neonatal transport unit 12. The mounting frame 28 can sit below the supporting equipment 30 and the incubation chamber 26, and can include one or more bars 31 for supporting the weight of the incubation chamber 26 and the supporting equipment 30. In some cases, the mounting frame 28 is formed of a metal or alloy(s) thereof, however, it is understood that mounting frame 28 could be formed of any other material (e.g., a composite material) configured to support the weight of the incubation chamber 26 and supporting equipment 30.

Returning to FIGS. 1 and 2, and with particular reference to FIG. 2, the apparatus 10 according to various implementations can include an isolation stage 32; a first mount 34 on a first portion 36 of the isolation stage 32; and a second mount 38 on a second portion 40 of the isolation stage 32. The apparatus 10 can further include a stabilizing coupler 42 extending from the second portion 40 of the isolation stage 32.

The isolation stage 32 can include a z-isolation stage, configured to isolate vibration of the neonatal transport unit 12 in a Z direction. As described herein, the Z direction is the vertical direction that is normal to the floor 16. The X direction is the first direction perpendicular to the Z direction and parallel with a direction of travel of the vehicle having the floor 16. The Y direction is the second direction perpendicular to the Z direction, and is also perpendicular to the X direction.

The z-isolation stage (or simply, isolation stage) 32 can include a scissor mechanism 44 for constraining movement of the neonatal transport unit 12 in terms of pitch and roll, while allowing movement in the Z direction (FIG. 2). In various implementations, the scissor mechanism 44 includes a central joint 46 and a set of arms 48 coupled at the central joint 46. The set of arms 48 can be configured to pivot about the central joint 46 in order to isolate relative vibration between the neonatal transport unit 12 and the stretcher mount 22. That is, the central joint 46 permits movement of the arms 48 in the Z direction in order to isolate vibration between the neonatal transport unit 12 and the stretcher mount 22. As shown in FIG. 2, the scissor mechanism 44 can include parallel subsets of arms 48A, 48B, and may include two distinct central joints 46A, 46B which are coaxially aligned in the Z and Y direction. These arms 48A, 48B can be joined by cross members 50, which couple the subsets of arms 48A, 48B at ends of those arms 48A, 48B opposite the central joint 46.

In various implementations, the isolation stage 32 can also include a first set of linear bearings 52 (partially obstructed in this view), which permit movement of the neonatal transport unit 12 in the Y direction (FIG. 2). The isolation stage 32 can also include a second set of linear bearings 54, which permit movement of the neonatal transport unit 12 in the X direction. In some implementations, thrust bearings 56 (e.g., located between linear bearings 52, 54) permit yaw in the neonatal transport unit 12. The isolation stage 32 can utilize one spring assembly 60 and one damper 62 per degree of freedom in order to center itself in the X direction, Y direction and yaw axis. As shown in FIG. 2, in some implementations, the isolation stage 32 can include three spring assemblies 60. The spring assembly 60 in the middle of the isolation stage 32 (along X direction) can be configured to center the stage 32 in the X direction, while the spring assemblies 60 at the ends of the stage 32 are configured to constrain movement in the Y direction and yaw axis. It is understood that in this view, the damper 62 corresponding with the middle spring assembly 60 is obstructed by that spring assembly 60.

Figure 5:
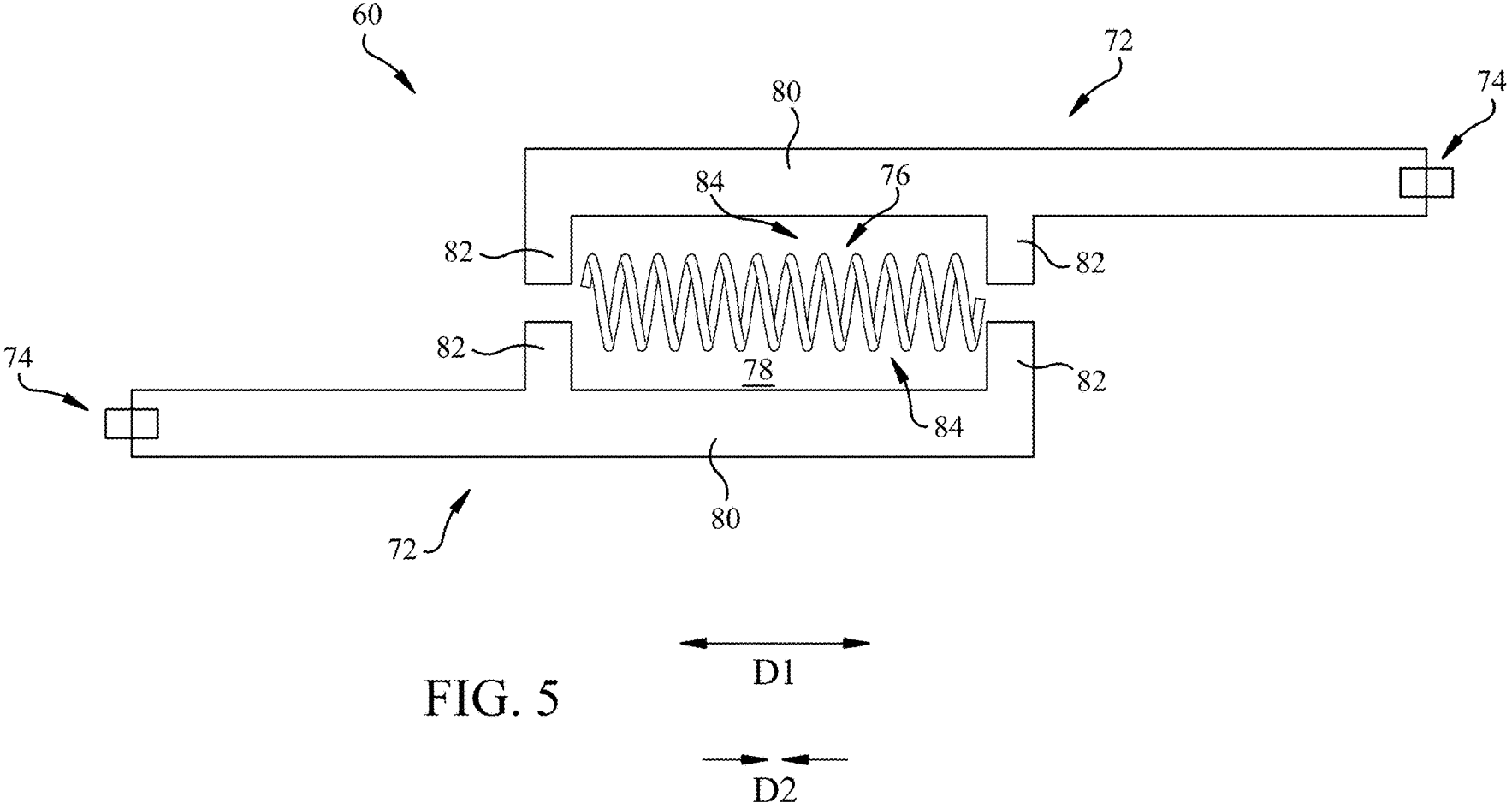
FIG. 5 shows a schematic cross-sectional view of a spring assembly according to various implementations.

FIG. 5 shows a cross-sectional depiction of one example implementation of a spring assembly 60. This example spring assembly 60 may be representative of one or more spring assemblies 60 shown and described with respect to FIG. 2. As shown in FIG. 5, the spring assembly 60 can include a pair of aligned actuators 72 with opposing couplers 74. Between the pair of aligned actuators 72 is a spring 76. In various implementations, the actuators 72 define an inner chamber 78 where the spring 76 resides. In some cases, each actuator 72 includes an arm 80 and a set of tabs 82 extending from the arm 80 to define a slot 84. According to some implementations, the slots 84 can be approximately equal in size (e.g., such that spacing between tabs 82 is approximately equal). Spring 76 can have a spring diameter that is greater than a spacing between opposing tabs 82, such that spring 76 is contained within the inner chamber 78 formed by the opposing slots 84. Each coupler 74 can be configured to connect with a control member (not shown), which can include a rod, hook, tab, etc. for actuating the actuator(s) 72 and engaging the spring 76. In particular implementations, as shown in FIG. 5, actuating the pair of aligned actuators 72 in either of two distinct directions (D1, or pulling; and D2, or pushing) imparts a compressive force on the spring 76.

Returning to FIG. 2, according to various implementations, the isolation stage 32 can further include an air spring 86 for controlling vertical centering of the isolation stage 32 and the neonatal transport unit 12 (FIG. 1). In various implementations, the air spring 86 can include an air chamber 88 and a pair of couplers 90 connecting the air chamber 88 with arms 48 in the isolation stage 32. In some cases, the air spring 86 can be aligned such that couplers 90 connect to distinct arms 48 in the scissor mechanism 46. According to various implementations, an air container 92 is connected with the air chamber 88, e.g., via a free-flowing conduit or tube, and allows for the flow of air between the air chamber 88 and the air container 92. The air container 92 can include an air tank, or other vessel for holding air. In steady state or a state of insignificant movement, the pressure within air chamber (or, chamber) 88 and air container (or, container) 92 are substantially equal. However, where the system experiences a movement such that the incubation chamber 12 is brought closer to the floor 16, the chamber 88 can vent air to container 92 to temporarily relieve the pressure within the chamber 88. When the height of the incubation chamber 12 is returned to its steady state height, air returns back to the chamber 88 from the container 92. In cases where the incubation chamber 12 moves away from the floor 16 from its steady state height, container 92 can provide air to the chamber 88 in order to prevent a significant pressure drop in that chamber 88. Similarly, when the incubation chamber 12 returns to its steady state height, that excess air in the chamber 88 returns to the container 92. The additional air container 92 in this configuration can effectively decrease the spring rate of the air spring 86 relative to air springs without this container, i.e., by lowering the rate of change of force with respect to displacement. In some implementations, the vehicle can provide the source of air to the air spring 86. In certain cases, that air source can include a filter system (e.g., a tankless air compressor) configured to feed air to the air spring 86 for controlling the vertical centering of the isolation stage 32. In some implementations, the air source can include a controller such as a valve, knob or user interface for actuating flow of the air from the air source to the air spring 86. In certain cases, the air source includes a control stop mechanism such as a valve for maintaining an amount of air in the air spring 86 based upon a desired position of the stretcher 14 relative to the neonatal transport unit 12 (FIG. 1).

Returning to FIGS. 1 and 2, as noted herein, the apparatus 10 can further include first mount 34 on the first portion 36 of the isolation stage 32. The first mount 34 can be configured to engage the mounting frame 28 of the neonatal transport unit 12 (FIG. 1, FIG. 4). In particular implementations, the first mount 34 is located proximate a top portion of the apparatus 10 in order to engage the mounting frame 28 from below. The first mount 34 can be coupled with at least one of the arms 48 (e.g., two arms 48) of the isolation stage 32, and in some cases, can span the length of the isolation stage 32 in the X-direction. The first mount 34 can include a clamping system 98 for clamping the mounting frame to the isolation stage. Clamping system 98 can include a set of clamps 100, which are movable between engaged and disengaged positions, to connect the apparatus 10 with the mounting frame 28. In some cases, the clamps 100 can include hooks, pins, tabs, or other actuatable mechanisms configured to couple the apparatus 10 with the mounting frame 28. In various particular implementations, the clamps 100 can be coupled with a rotating crank member 102 (e.g., handle) for engaging/disengaging the clamps 100 with the mounting frame 28. According to various implementations, the clamping system 98 eliminates lash (or, looseness) between the mounting frame 28 and the isolation stage 32.

As noted herein, the apparatus 10 can further include the second mount 38 on the second portion 40 (e.g., distinct from first portion 36) of the isolation stage 32. In various implementations, the second mount 38 is configured to engage the stretcher 14 (FIG. 1). In some cases, the second mount 38 includes two distinct mounts 38A, 38B on two distinct arms 48 in the set of arms (FIG. 2). The second mounts 38A, 38B can include one or more clamps, mating features (e.g., male/female mating features) or other couplers for connecting the arms 48 with the stretcher 14. In some cases, as shown most clearly in FIG. 2, the isolation stage 32 can further include a strut 104 connecting distinct arms 48 proximate the second portion 40 of the isolation stage 32. During operation, when the vehicle is accelerating in the X direction (either positively or negatively), the force to accelerate the payload is transmitted through pivot joints at the second mount 38B. The stretcher 14 exhibits some lash in the X direction, making it inappropriate for carrying these loads to the floor. As such, the strut 104 can carry these X-direction loads to the floor, without lash or significant compliance.

The stabilizing coupler 42 can extend from the second portion 40 of the isolation stage 32. The stabilizing coupler 42 can include one or more arms 106 extending from the second portion 40 of the isolation stage 32, having a length ($L_{sc}$) approximately equal to the height of the stretcher 14 when that stretcher 14 is engaged with the floor 16. That is, in various implementations, when engaged with the stretcher 14 in a vehicle, the stabilizing coupler 42 can include at least one arm 106 extending to reach the floor 16. This stabilizing coupler 42 can be positioned to directly couple the isolation stage 32 with the floor 16 underlying stretcher 14. The stabilizing coupler 42 is configured to connect the isolation stage 32 with the floor 16 in addition to the connection between the stretcher 14 and the floor 16 (via the floor coupler 24).

Stabilizing coupler 42 can further include at least one mount 108 for connecting the arm(s) 106 with the floor 16. In some example implementations, as shown in the depiction of FIG. 2, the mount 108 can include one or more plates 110 (e.g., retractable plates) having apertures for receiving a coupler to connect the plate(s) 110 with the floor 16. In this example implementation, the plate 110 can be bolted, screwed, pinned, removably clipped or otherwise coupled with the floor 16 to stabilize the isolation stage 32. In some example implementations, as shown in FIGS. 1 and 2, a plurality of stabilizing couplers 42 can be utilized to directly connect the isolation stage 32 with the floor 16. In these cases, a second set of stabilizing couplers 42A extend from the isolation stage 32 for coupling with the floor 16. In some cases, stabilizing couplers 42 are located at the forward portion of the isolation stage 32 (relative to direction of travel) to reduce lash and compliance between the isolation stage and the floor. However, the additional stabilizing couplers 42A can also be located at the rear of the isolation stage 32 to further reduce lash and compliance between the isolation stage 32 and the floor. While a plurality of stabilizing couplers 42 are shown in the depictions in FIGS. 1 and 2, in some other implementations, a single stabilizing coupler 42 can be used to couple the isolation stage 32 with the floor (e.g., by coupling both ends of the scissor mechanism 44 with the floor).

In still other implementations, additional arms 106 and plate(s) 110 can be located on the second mounts 38B at the aft of the isolation stage 32 to transmit the X-direction loads to the floor during transport (not shown). In these implementations, the additional arms 106 and plate(s) 110 can replace the strut 104 in transmitting those X-direction loads to the floor. That is, the additional arms 106 and plate(s) 110 can be used as an alternative to the strut 104 configuration shown and described with reference to FIG. 2.

In particular implementations, the stabilizing coupler(s) 42, 42A are further configured to couple the isolation stage 32 with the stretcher 14, e.g., to reduce lash between these components. The stabilizing couplers 42, 42A can include stretcher mount couplers 112 for connecting with the stretcher mount 22, in addition to the mount 108 for connecting those stabilizing couplers 42, 42A with the floor. These stretcher mount couplers 112 can rest on the stretcher mount 22, and can include mating features such as male/female couplings, pins, screws, brackets, etc. for connecting the isolation stage 32 with the stretcher 14.

Figure 6:
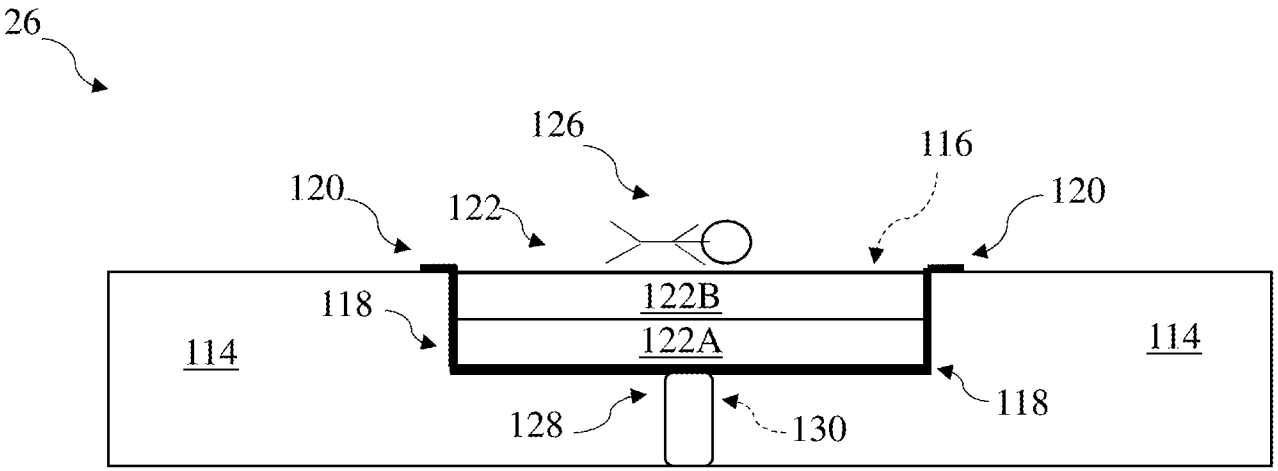
FIG. 6 shows a schematic partial cut-away view of a neonatal transport unit according to various implementations.

FIG. 6 shows a schematic depiction of the interior of a neonatal transport unit 12 according to particular implementations. In particular, FIG. 6 illustrates details of an incubation chamber 26 according to particular implementations. In these cases, the incubation chamber 26 can include a platform 114 having a recess 116 therein (recess indicated by phantom arrow, as filled in this depiction). The platform 114 can be formed of a material such as a hard plastic or other material that can be shaped to form the recess 116. Inside the recess 116 is a removable tray 118, which can include a lip 120 extending above the recess 116 (e.g., for ease of installation/removal). The tray 118 can be formed of a plastic such as polypropylene, in some example implementations. Inside the tray 118 is at least one cushion layer 122 (two shown, as 122A, 122B). In some cases, the at least one cushion layer 122 includes a foam layer, which can be made of any conventional foam mattress material such as urethane. In some example implementations the at least one cushion layer 22 includes a gel mattress. It is understood that the cushion layer(s) 122 can be configured to contact a child and provide cushioning and/or cooling. In some cases, only one cushion layer 122 is located inside tray 118, while in other cases, a plurality of cushion layers 122, of a same or different type of material, can be located inside tray 118 to provide cushioning and/or temperature control for a child 126. The child 126 is illustrated resting on one of the cushion layers 122. In some cases, the tray 118 is configured to dampen vibration from travel-related movement and reduce the negative impact of that travel on the child 126.

In some optional implementations, the incubation chamber 26 can further include a reinforcing member 128 in a slot 130 (within platform 114) under the tray 118 for providing additional support during travel. In these cases, the reinforcing member 128 can reduce vibration experienced by the child 126, as well as mitigate resonances from travel-related movement. That is, the reinforcing member 128 can reduce compliance in the incubation chamber 26, in preventing the tray 118 from hitting the platform 114, thereby avoiding the acceleration associated with contact between the tray 118 and the platform 114.

As described herein, one or more portions of the apparatus 10 can be formed in an integral process (e.g., via casting, stamping, forging and/or three-dimensional manufacturing), or can be formed separately and subsequently joined together (e.g., via welding, brazing and/or mechanical linking). Components in the apparatus 10 can be formed of a material capable of supporting the loads described herein, and may include, metals (e.g., steel, aluminum), alloys of one or more metals, plastics, composite materials, etc.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). Additionally, subcomponents within a given component can be considered to be linked via conventional pathways, which may not necessarily be illustrated.

Couplers and couplings described herein can include one or more conventional mechanical linkages. For example, couplers/couplings described herein can include male/female mating features, screws, bolts, pins, complementary joints, brackets, sleeves, slots/grooves and associated mating members, revolute joints, linear bearings, etc. These and/or other conventional couplings can be used according to various implementations.

A number of implementations have been described. Nevertheless, it will be understood that additional modifications may be made without departing from the scope of the inventive concepts described herein, and, accordingly, other implementations are within the scope of the following claims.

I claim:

1. An apparatus comprising:

an isolation stage;

a first mount on a first portion of the isolation stage, the first mount configured to engage a mounting frame of a neonatal transport unit;

a second mount on a second portion of the isolation stage, the second mount configured to engage a stretcher; and a stabilizing coupler extending from the second portion of the isolation stage, the stabilizing coupler positioned to directly couple the isolation stage with a floor underlying the stretcher;

wherein the stabilizing coupler is configured to couple the isolation stage with the floor in addition to a connection between the stretcher and the floor, wherein the stabilizing coupler is further configured to couple the isolation stage with the stretcher.

2. The apparatus of claim 1, wherein the isolation stage comprises a z-isolation stage configured to isolate vibration of the neonatal transport unit in a Z direction, the Z direction being normal to the floor underlying the stretcher.

3. The apparatus of claim 2, wherein the z-isolation stage further comprises a scissor mechanism.

4. The apparatus of claim 3, wherein the scissor mechanism further comprises:

a central joint; and a set of arms coupled at the central joint, the set of arms configured to pivot about the central joint for isolating relative vibration between the neonatal transport unit and a mount of the stretcher.

5. The apparatus of claim 4, wherein the second mount comprises two distinct mounts on two distinct arms in the set of arms, and wherein the z-isolation stage further comprises a strut connecting the two distinct arms.

6. The apparatus of claim 4, wherein the central joint permits movement of the set of arms in the Z direction, and wherein the isolation stage further comprises:

a first set of linear bearings permitting movement of the neonatal transport unit in an X direction perpendicular to the Z direction;

a second set of linear bearings permitting movement of the neonatal transport unit in a Y direction perpendicular to the Z direction and the X direction; and a set of thrust bearings permitting yaw in the neonatal transport unit.

7. The apparatus of claim 1, wherein the first mount comprises a clamping system for clamping the mounting frame to the isolation stage.

8. The apparatus of claim 7, wherein the clamping system eliminates looseness between the mounting frame and the isolation stage.

9. The apparatus of claim 1, wherein the isolation stage is centered in an X direction by a spring assembly, and is centered in a Y direction by additional spring assemblies, the X direction being a first direction parallel with the floor and the Y direction being a second direction parallel with the floor and perpendicular with the X direction.

10. The apparatus of claim 9, wherein at least one of the spring assembly or the additional spring assemblies comprises:

a pair of aligned actuators having opposing couplers; and a spring between the pair of aligned actuators, wherein actuating the pair of aligned actuators in either of two distinct directions imparts a compressive force on the spring.

11. The apparatus of claim 1, wherein the isolation stage further comprises an air spring for controlling vertical centering of the neonatal transport unit.

12. The apparatus of claim 11, wherein the air spring comprises an air chamber and an air container fluidly connected with the air chamber, wherein air is configured to flow freely between the air chamber and the air container to control a spring rate of the neonatal transport unit.

13. The apparatus of claim 1, wherein the floor comprises a floor of a roadway compliant vehicle or an airborne compliant vehicle.

14. A system comprising:

a stretcher including:

a set of wheels;

a stretcher mount coupled with the set of wheels;

a floor coupler for anchoring the stretcher to a floor underlying the stretcher; and an isolation apparatus coupled with the stretcher mount, the isolation apparatus including:

an isolation stage;

a first mount on a first portion of the isolation stage, the first mount configured to engage a neonatal transport unit;

a second mount on a second portion of the isolation stage, the second mount coupled with the stretcher mount of the stretcher; and a stabilizing coupler extending from the second side of the isolation stage, the stabilizing coupler positioned to directly couple the isolation stage with the floor, the stabilizing coupler configured to couple the isolation stage to the floor in addition to a connection between the floor coupler, wherein the stabilizing coupler is further configured to couple the isolation stage with the stretcher;

wherein the isolation stage comprises a z-isolation stage configured to isolate vibration of the neonatal transport unit in a Z direction normal to the floor.

15. The system of claim 14, wherein the isolation stage comprises a z-isolation stage configured to isolate vibration of the neonatal transport unit in a Z direction normal to the floor, the z-isolation stage having a scissor mechanism comprising:

a central joint; and a set of arms coupled at the central joint, the set of arms configured to pivot about the central joint for isolating relative vibration between the neonatal transport unit and the stretcher mount.

16. The system of claim 14, wherein the neonatal transport unit comprises an incubation chamber and a mounting frame coupled with the incubation chamber, and the first mount comprises a clamping system for clamping the mounting frame to the isolation stage.

17. A system comprising:

a neonatal transport unit having:

a mounting frame; and an incubation chamber coupled with the mounting frame, the incubation chamber containing: a platform having a recess therein; at least one removable tray in the recess; and at least one cushion layer over the at least one removable tray within the recess; and an isolation apparatus coupled with the neonatal transport unit, the isolation apparatus having:

an isolation stage;

a first mount on a first portion of the isolation stage, the first mount coupled with the mounting frame of the neonatal transport unit;

a second mount on a second portion of the isolation stage, the second mount configured to engage a stretcher; and a stabilizing coupler extending from the second side of the isolation stage, the stabilizing coupler positioned to directly couple the isolation stage with a floor underlying the stretcher, wherein the stabilizing coupler is configured to couple the isolation stage with the floor in parallel with a connection between the stretcher and the floor.

18. An apparatus comprising:

a z-isolation stage having a scissor mechanism configured to isolate vibration of a neonatal transport unit in a Z direction;

a first mount on a first portion of the isolation stage, the first mount configured to engage a mounting frame of the neonatal transport unit;

a second mount on a second portion of the isolation stage, the second mount configured to engage a stretcher; and a stabilizing coupler extending from the second portion of the isolation stage, the stabilizing coupler positioned to directly couple the isolation stage with a floor underlying the stretcher.

* * * * *